US008347942B1

(12) United States Patent
Ma

(10) Patent No.: US 8,347,942 B1
(45) Date of Patent: Jan. 8, 2013

(54) METHOD OF MANUFACTURING WHEEL HAVING AN ALLOY RIM AND CFRP REINFORCEMENTS

(76) Inventor: Shui Yuan Ma, Taichung (TW)

( * ) Notice: Subject to any disclaimer, the term of this patent is extended or adjusted under 35 U.S.C. 154(b) by 0 days.

(21) Appl. No.: 13/485,946

(22) Filed: Jun. 1, 2012

(51) Int. Cl.
*B22D 19/02* (2006.01)

(52) U.S. Cl. ..... 164/98; 164/97

(58) Field of Classification Search ..... 164/97, 164/98
See application file for complete search history.

(56) References Cited

U.S. PATENT DOCUMENTS 6,238,506 B1 * 5/2001 Satoh et al. ..... 156/169
2009/0143524 A1 * 6/2009 Nakayama et al. ..... 524/450

* cited by examiner

*Primary Examiner* — Kuang Lin

(57) ABSTRACT

A method of manufacturing a vehicle wheel is provided with the steps of forming a wheel rim preform by injection molding a material made of alloy wherein the wheel rim preform includes a holed center, a grooved rim, a plurality of spokes interconnecting the holed center and an inner surface of the grooved rim, and a plurality of openings each formed in the spoke; preparing an endless CFRP work piece; cutting the CFRP work piece into a plurality of CFRP members; placing the CFRP members in the openings of the spokes; and heating the wheel rim perform at a predetermined temperature for a predetermined period of time to melt the CFRP members, thereby forming a finished wheel.

6 Claims, 10 Drawing Sheets

METHOD OF MANUFACTURING WHEEL HAVING AN ALLOY RIM AND CFRP REINFORCEMENTS

BACKGROUND OF THE INVENTION

1. Field of the Invention

The invention relates to vehicle wheels and more particularly to a method of manufacturing a vehicle wheel having an alloy rim and reinforcements made of carbon-fiber-reinforced polymer or carbon-fiber-reinforced plastic (CFRP).

2. Description of Related Art

Alloy wheels are automobile (e.g., car, motorcycle and truck) wheels which are made from an alloy of aluminum or magnesium. They are typically lighter for the same strength and provide better heat conduction. The earliest light alloy wheels were made of magnesium alloys. Alloy wheels are favored due to low manufacturing cost. However, until this time most aluminum wheels suffered from low ductility, usually ranging from 2-3% elongation. This meant these earlier aluminum alloy wheels were quite brittle.

CFRP is a very strong and light fiber-reinforced polymer which contains carbon fibers. The polymer is most often epoxy, but other polymers, such as polyester, vinyl ester or nylon, are sometimes used. The composite may contain other fibers, such as Kevlar, aluminium, or glass fibers, as well as carbon fibers. Although carbon fiber can be relatively expensive, it has many applications in aerospace and automotive fields. The compound is also used in sailboats, modern bicycles, and motorcycles, where its high strength-to-weight ratio and good rigidity is of importance. Improved manufacturing techniques are reducing the costs and time to manufacture, making it increasingly common in small consumer goods as well, such as laptops, tripods, fishing rods, tent poles, racquet frames, golf clubs, and helmets.

As far as the present inventor is aware, no vehicle wheel having an alloy rim and reinforcements made of CFRP is commercially available.

SUMMARY OF THE INVENTION

It is therefore one object of the invention to provide a method of manufacturing a wheel comprising the steps of forming a wheel rim preform by injection molding a material made of alloy wherein the wheel rim preform comprises a holed center, a grooved rim, a plurality of spokes interconnecting the holed center and an inner surface of the grooved rim, and a plurality of openings each formed in the spoke; preparing an endless CFRP work piece; cutting the CFRP work piece into a plurality of CFRP members; placing the CFRP members in the openings of the spokes; and heating the wheel rim perform at a predetermined temperature for a predetermined period of time to melt the CFRP members, thereby forming a finished wheel.

The above and other objects, features and advantages of the invention will become apparent from the following detailed description taken with the accompanying drawings.

DETAILED DESCRIPTION OF THE INVENTION

Referring to FIGS. 1 to 9, a flow chart of manufacturing a vehicle wheel in accordance with a first preferred embodiment of the invention is illustrated below. The formed vehicle wheels are small and can be used as bicycle wheels.

Figure 1:
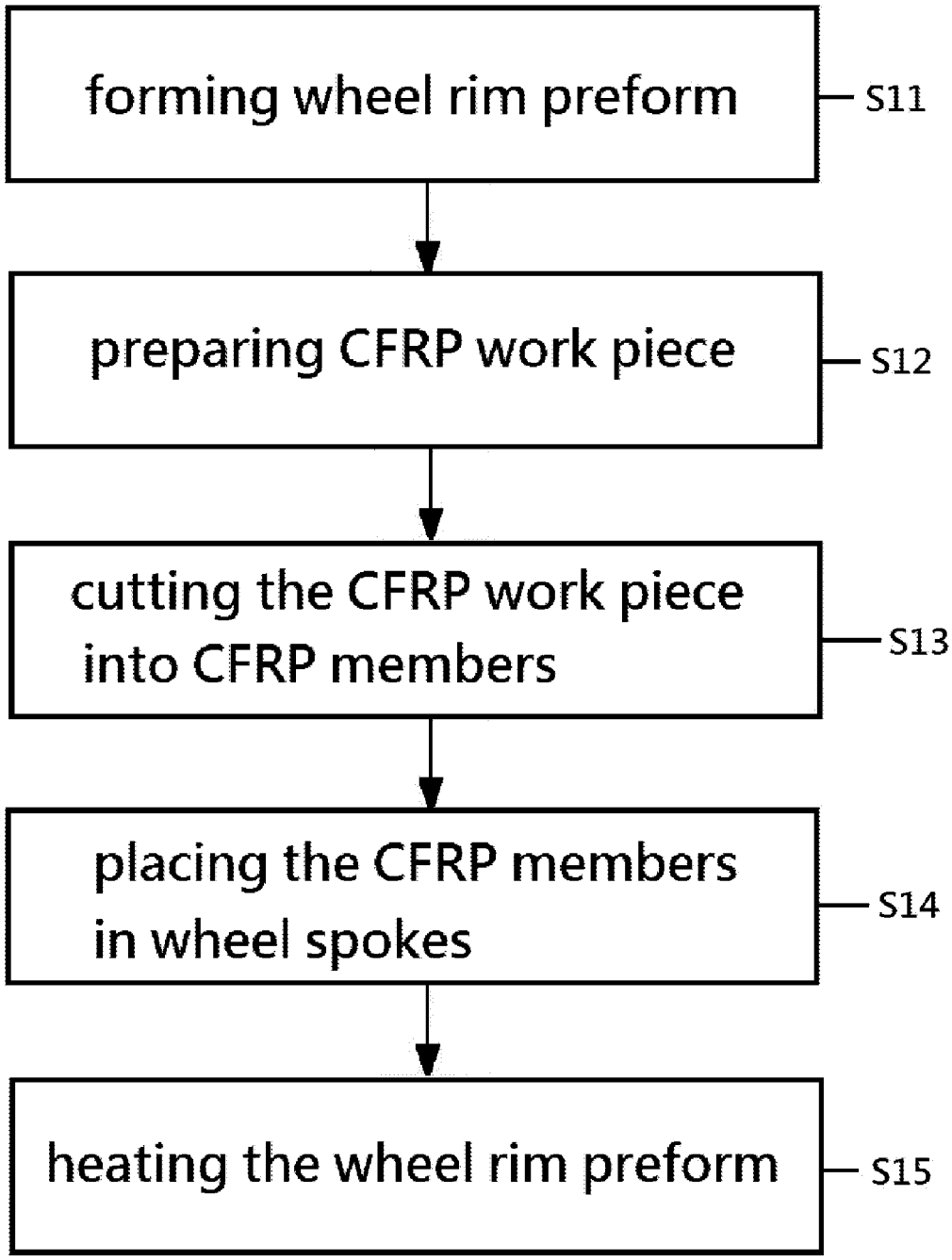
FIG. 1 is a flow chart diagram of manufacturing a vehicle wheel according to a first preferred embodiment of the invention.
Figure 2:
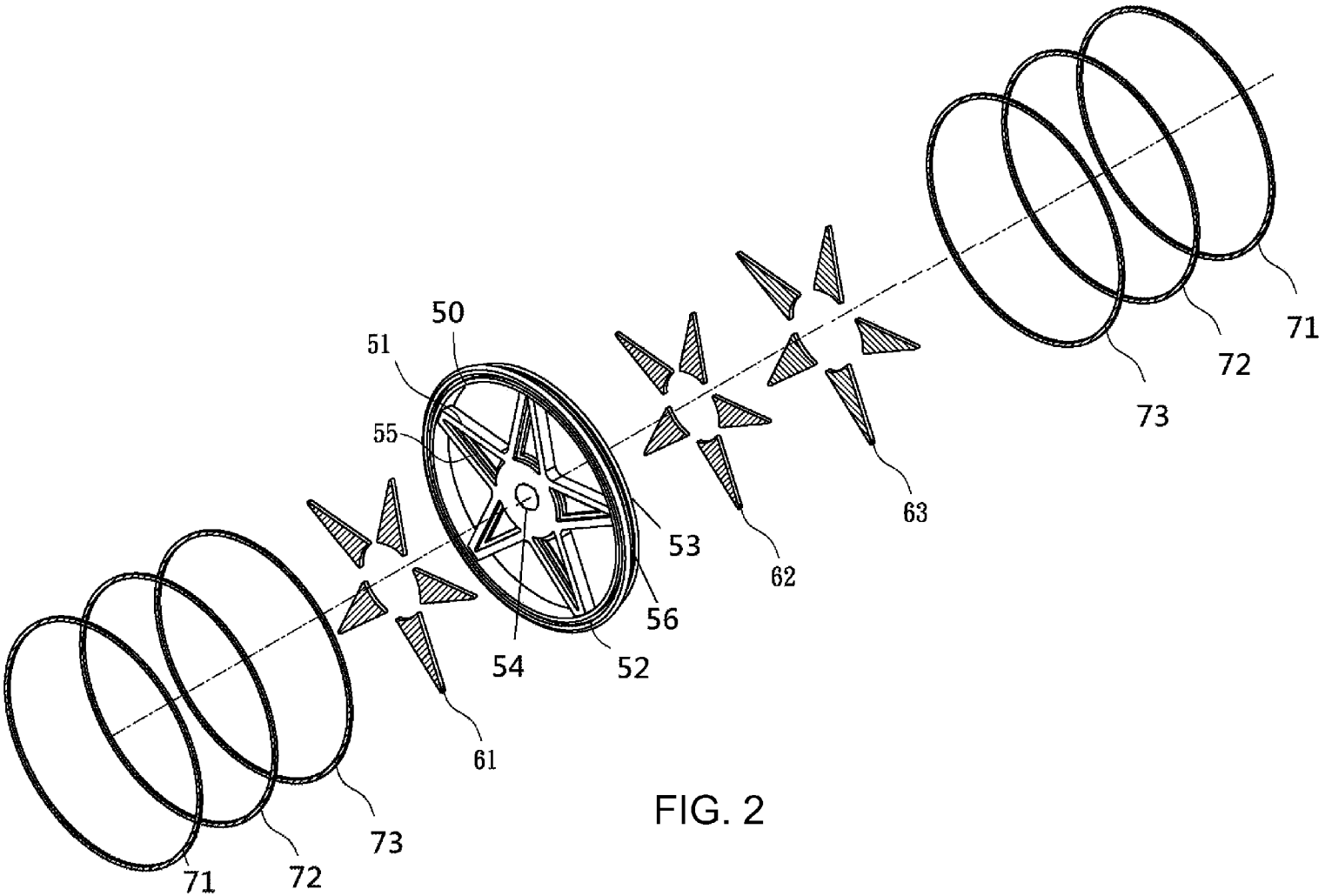
FIG. 2 is an exploded view of the vehicle wheel.

In FIG. 1, in step S11, a wheel rim preform 50 is formed by injection molding material made of alloy of aluminum or stainless steel. The wheel rim preform 50 is shaped as a disc and comprises a holed center 54, a grooved rim 56, five triangular spokes 51 interconnecting the center 54 and an inner surface of the rim 56, five triangular openings 55 each formed in the spoke 51 wherein one vertex of the opening 55 is formed at the inner surface of the rim 56, an annular outer recess 52 formed and spaced from one side of the rim 56, and an annular inner recess 53 formed and spaced from the other side of the rim 56.

Figure 3A:
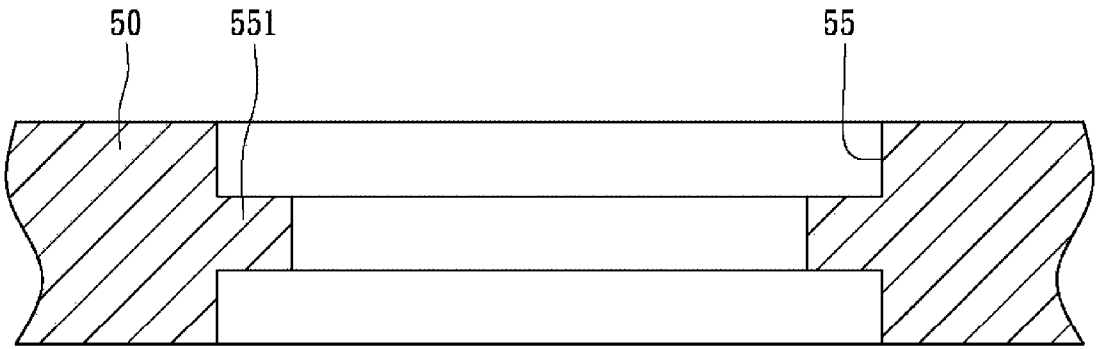
FIG. 3A is a cross-sectional view of a portion of the wheel rim perform showing one configuration of the opening in the spoke.
Figure 3B:
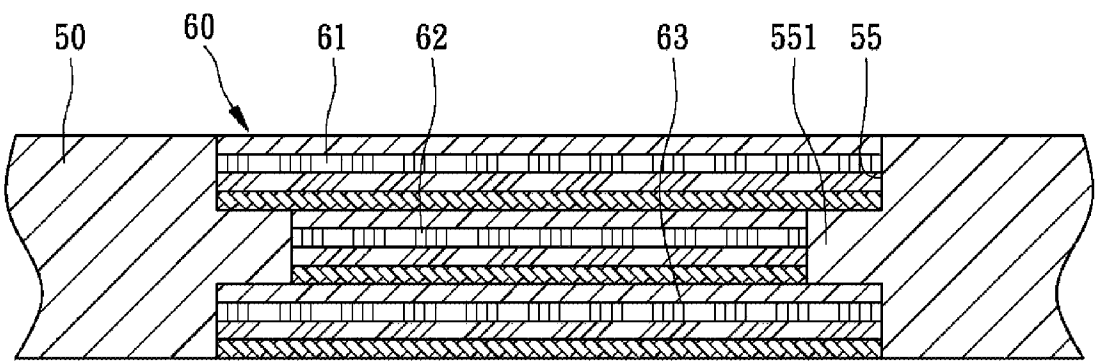
FIG. 3B is a view similar to FIG. 3A showing the first, second, and second reinforcements being disposed in the opening.
Figure 4A:
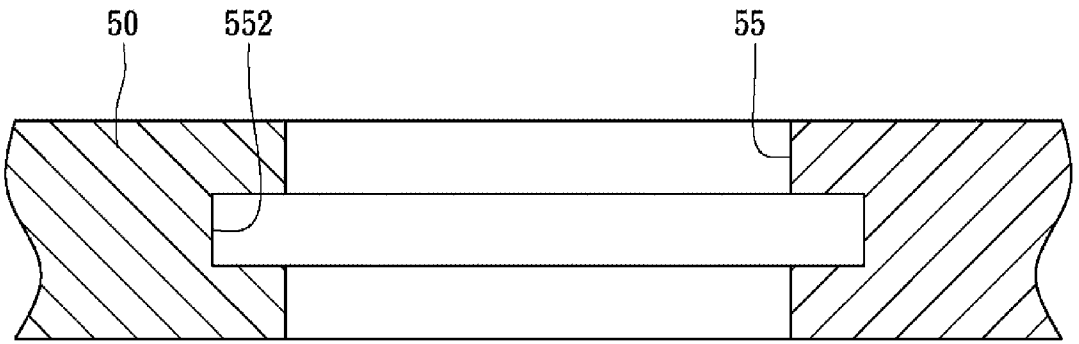
FIG. 4A is a cross-sectional view of a portion of the wheel rim perform showing the other configuration of the opening in the spoke.
Figure 4B:
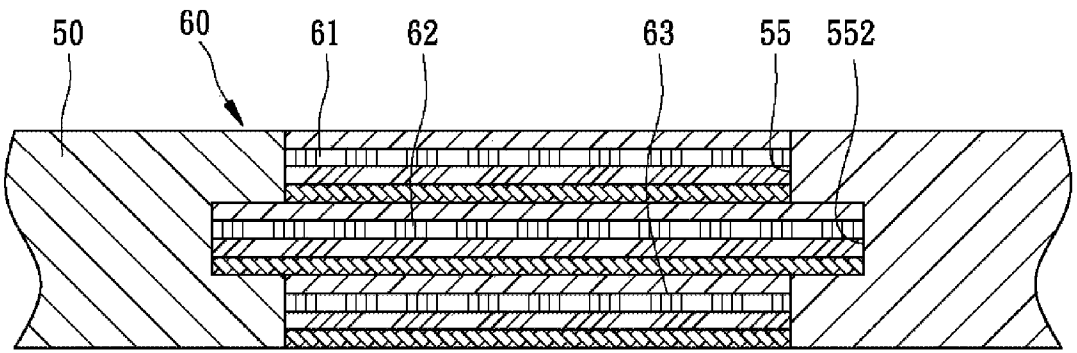
FIG. 4B is a view similar to FIG. 4A showing the first, second, and second reinforcements being disposed in the opening.
Figure 5A:
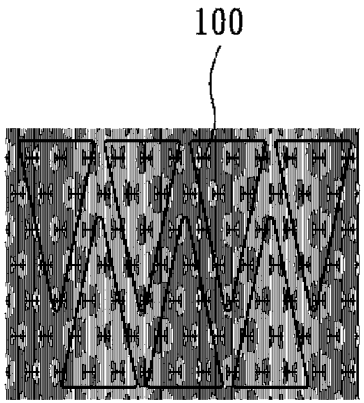
FIGS. 5A, 5B, 5C and 5D are plan view schematically showing first CFRP work piece, second CFRP work piece, third CFRP work piece, and fourth CFRP work piece respectively with first, second, third and fourth CFRP triangles to be cut therefrom.
Figure 5B:
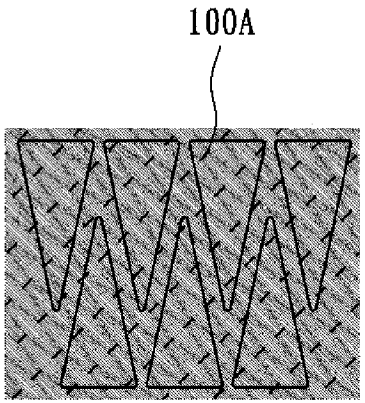
Figure 5C:
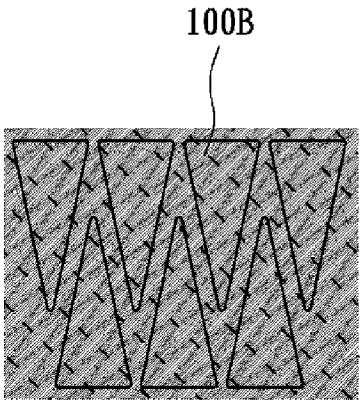
Figure 5D:
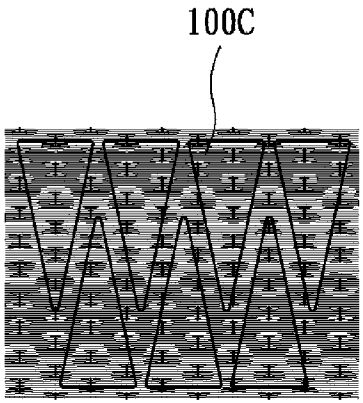

An inner surface of the opening 55 has an intermediate shoulder 551 in one configuration (see FIGS. 3A and 3B) or an intermediate cavity 552 in the other configuration (see FIGS. 4A and 4B).

In step S12, an endless work piece of CFRP is prepared. The CFRP contains epoxy, carbon fibers, glass fibers, polyester, and Kevlar wherein the epoxy has a weight percentage of 22 to 40. The epoxy is selected from the group consisting of polyurethane (PU), acrylonitrile-butadiene-styrene (ABS), polystyrene (PS), polycarbonate (PC), polyethylene (PE), acrylonitrile-styrene (AS), polymethylmethacrylate (PMMA), polyethylene terephthalate (PET), polyamide (PA), polybothlene terephthalate (PBT), polyether ether ketone (PEEK), and polyetherimide (PEI). The CFRP work piece is somewhat similar to cloth in nature and has warp yarn and weft yarn in the ratio of about 9 to 1. Epoxy is filled in gaps of the CFRP work piece. The CFRP work piece has its yarns drawn in a horizontal direction as a first CFRP work piece (see FIG. 5A), in an angle of 45-degree as a second CFRP work piece (see FIG. 5B), in an angle of 135-degree as a third CFRP work piece (see FIG. 5C), or in a vertical direction as a fourth CFRP work piece (see FIG. 5D). Further, a fifth CFRP work piece (not shown) is prepared.

Figure 6:
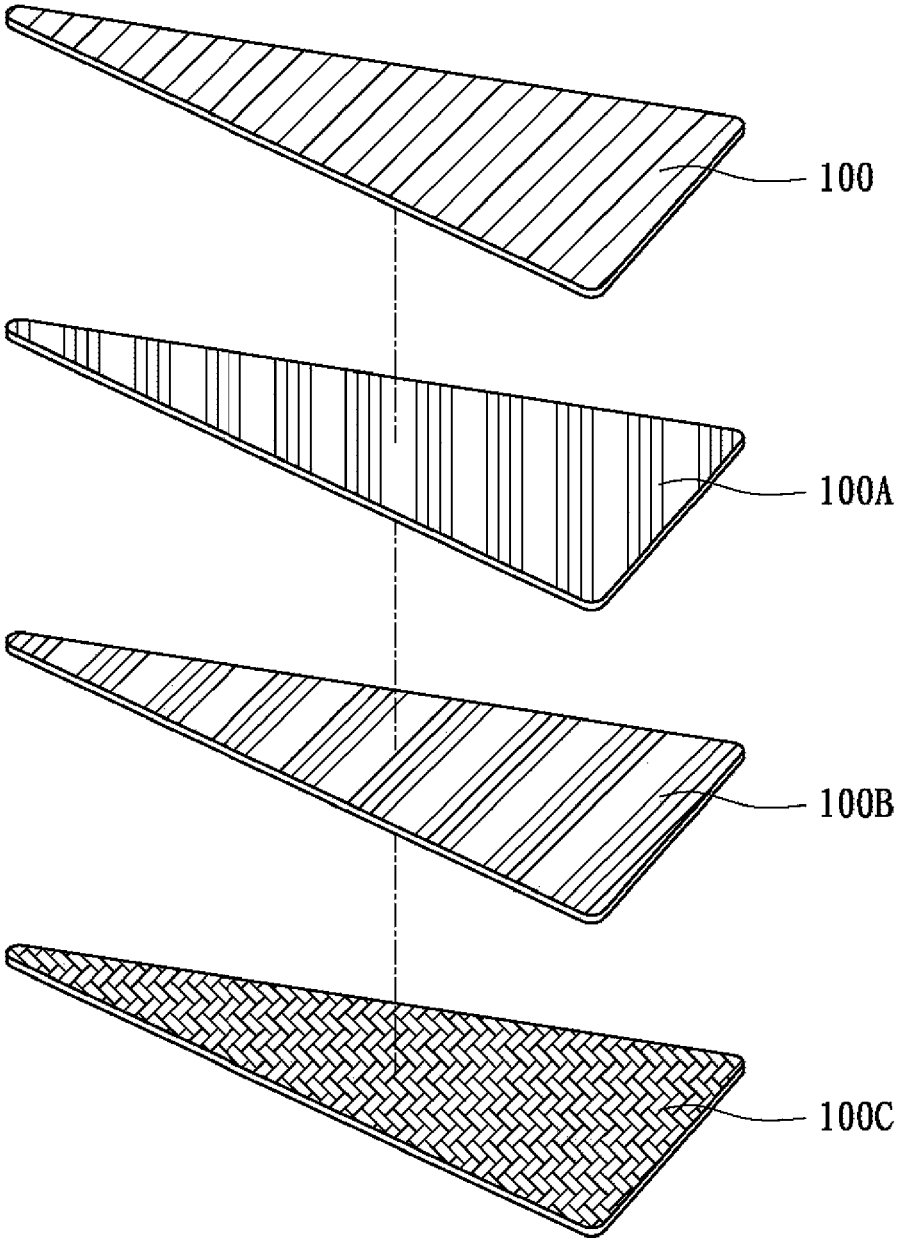
FIG. 6 is a perspective view showing the first, second, third and fourth CFRP triangles to be stacked as a first reinforcement, second reinforcement, or third reinforcement.

In step S13, the first CFRP work piece is cut into a plurality of first CFRP triangles 100, the second CFRP work piece is cut into a plurality of second CFRP triangles 100A, the third CFRP work piece is cut into a plurality of third CFRP triangles 100B, and the fourth CFRP work piece is cut into a plurality of fourth CFRP triangles 100C respectively (see FIG. 6). The first, second, third and fourth CFRP triangles 100, 100A, 100B and 100C are stacked together, heated, and pressed to form a first reinforcement 61, a second reinforcement 62, or a third reinforcement 63. The fifth CFRP work piece is cut into a plurality of first CFRP rings 71, a plurality of second CFRP rings 72, and a plurality of third CFRP rings 73.

Figure 7:
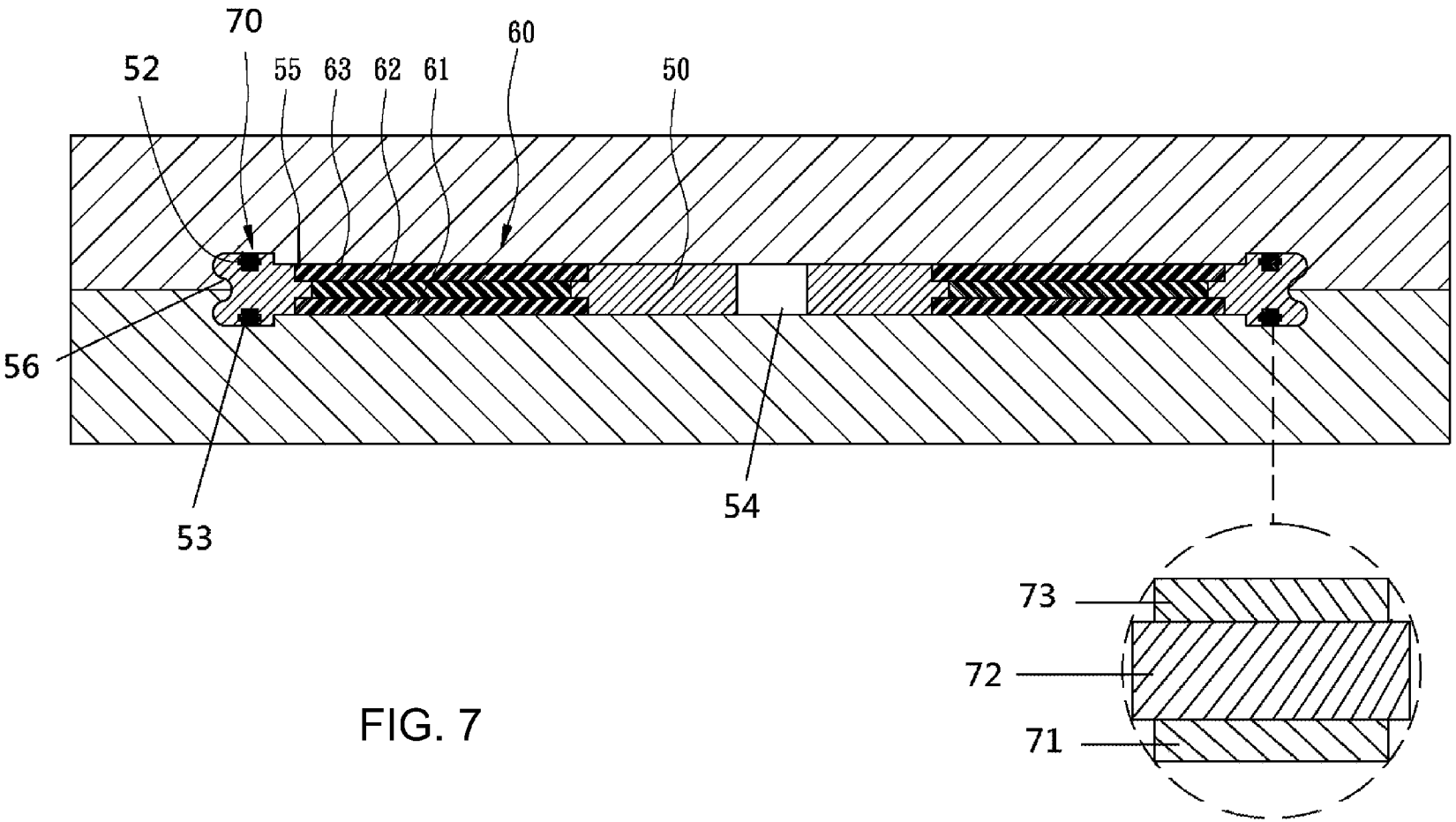
FIG. 7 is a cross-sectional view of the wheel rim perform, the placed first, second, and third reinforcements, and the placed first, second, and third CFRP rings in two attached dies prior to a finishing heating step.
Figure 8:
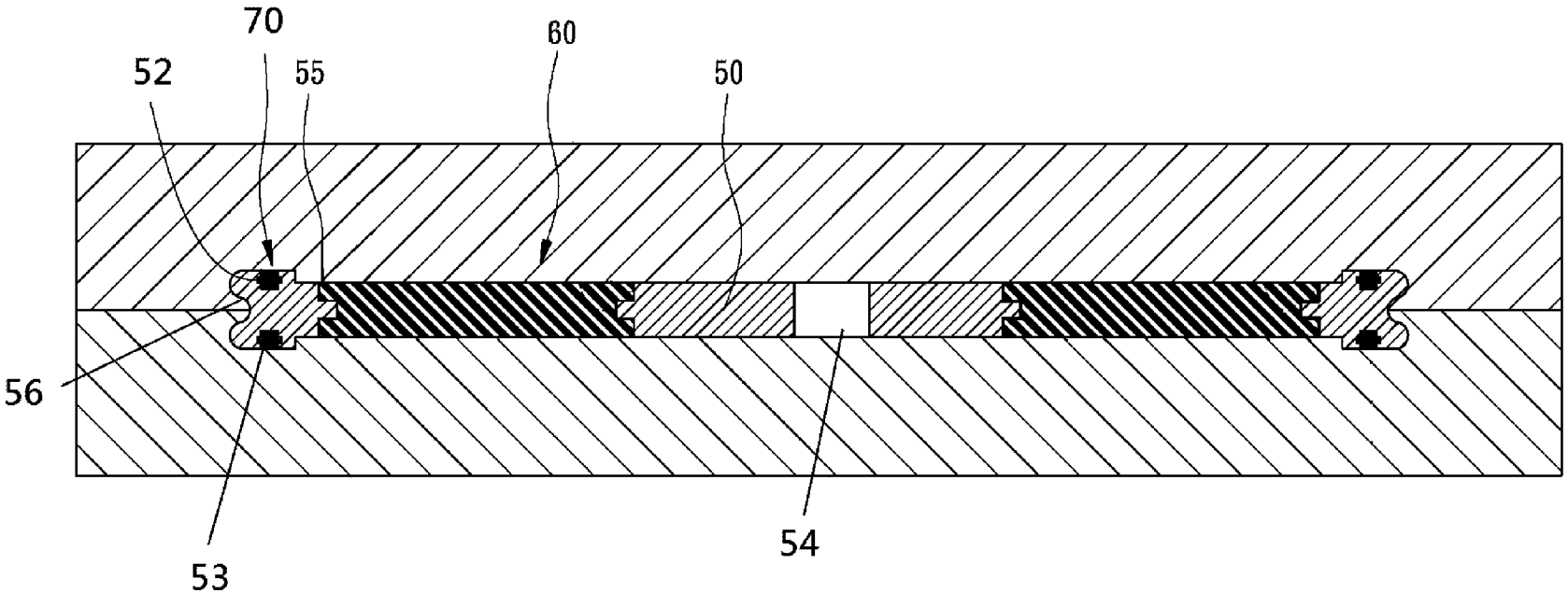
FIG. 8 is a view similar to FIG. 7 showing the finished wheel in the dies.

In step S14, as shown in FIG. 7, the third CFRP ring 73 is complementarily placed in an inner portion of the outer recess 52, the second CFRP ring 72 is complementarily placed in an intermediate portion of the outer recess 52, and the first CFRP ring 71 is complementarily placed in an outer portion of the outer recess 52 respectively. Also, the third CFRP ring 73 is complementarily placed in an inner portion of the inner recess 53, the second CFRP ring 72 is complementarily placed in an intermediate portion of the inner recess 53, and the first CFRP ring 71 is complementarily placed in an outer portion of the inner recess 53 respectively.

As shown in FIGS. 3A and 3B, in one configuration, the third reinforcement 63 is complementarily placed in an inner portion of the opening 55, the second reinforcement 62 is complementarily placed in the intermediate shoulder 551 of the opening 55, and the first reinforcement 61 is complementarily placed in an outer portion of the opening 55 respectively.

As shown in FIGS. 4A and 4B, in the other configuration, the third reinforcement 63 is complementarily placed in an inner portion of the opening 55, the second reinforcement 62 is complementarily placed in the intermediate cavity 552 of the opening 55, and the first reinforcement 61 is complementarily placed in an outer portion of the opening 55 respectively.

Figure 9:
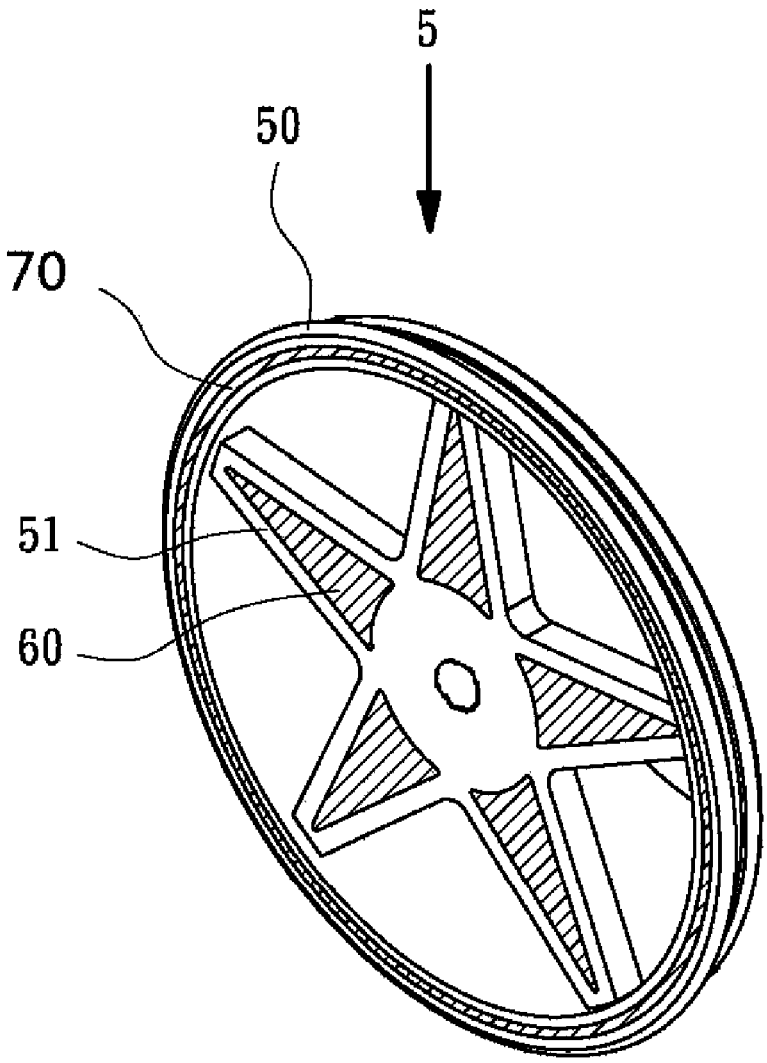
FIG. 9 is a perspective view of the finished wheel.

In the step S15, one configuration shown in FIGS. 3A and 3B is taken as an exemplary example and discussed below. The wheel rim perform 50, the first, second, and third reinforcements 61, 62, and 63, and the first, second, and third CFRP rings 71, 72, and 72 held in place are heated in a temperature between 120° C. and 260° C. for 30 to 60 minutes prior to cooling and finishing. As a result, as shown in FIG. 9, a wheel 5 has a first reinforcement member 60 formed in the hollow spokes 51 and two second reinforcement members 70 formed in the outer recess 52 and the inner recess 53 respectively.

Figure 10:
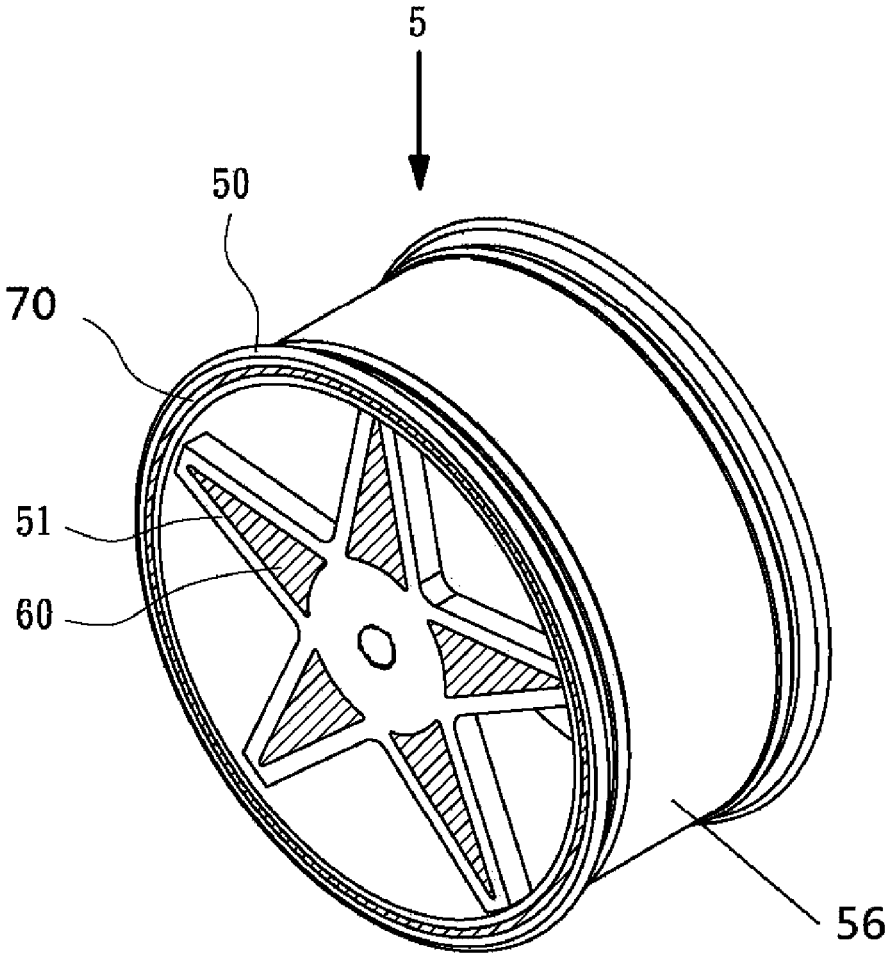
FIG. 10 is a perspective view of a finished wheel according to a second preferred embodiment of the invention.

Referring to FIG. 10, a vehicle wheel in accordance with a second preferred embodiment of the invention is shown. The formed vehicle wheels are large and can be used as car or motorcycle wheels. The characteristics of the second preferred embodiment are substantially the same as that of the first preferred embodiment except the following: The grooved rim 56 is much wider than that of the first preferred embodiment.

The finished wheel has the advantages of being light weight, being structurally strong, and being low in the manufacturing cost.

While the invention has been described in terms of preferred embodiments, those skilled in the art will recognize that the invention can be practiced with modifications within the spirit and scope of the appended claims.

What is claimed is:

1. A method of manufacturing a wheel comprising the steps of:

forming a wheel rim preform by injection molding a material made of alloy wherein the wheel rim preform comprises a holed center, a grooved rim, a plurality of spokes interconnecting the holed center and an inner surface of the grooved rim, and a plurality of openings each formed in each respective spoke;

preparing an endless CFRP work piece;

cutting the CFRP work piece into a plurality of CFRP members;

placing the CFRP members in the openings of the spokes;

heating the wheel rim perform at a predetermined temperature for a predetermined period of time to melt the CFRP members; and cooling to form CFRP reinforcements in the spokes of a finished wheel.

2. The method of claim 1, wherein the CFRP work piece is formed of epoxy, carbon fibers, glass fibers, polyester, and Kevlar.

3. The method of claim 2, wherein the epoxy is selected from the group consisting of polyurethane (PU), acrylonitrile-butadiene-styrene (ABS), polystyrene (PS), polycarbonate (PC), polyethylene (PE), acrylonitrile-styrene (AS), polymethylmethacrylate (PMMA), polyethylene terephthalate (PET), polyamide (PA), polybothlene terephthalate (PBT), polyether ether ketone (PEEK), and polyetherimide (PEI).

4. The method of claim 2, wherein the epoxy is about 22 to 40 wt % of the CFRP work piece.

5. The method of claim 1, wherein the CFRP work piece has a warp yarn to a weft yarn ratio of about 9 to 1.

6. The method of claim 1, wherein the predetermined temperature is between 120° C. and 260° C., and the predetermined period of time is 30 to 60 minutes.

* * * * *